US006427060B1

(12) United States Patent
Arakawa et al.

(10) Patent No.: US 6,427,060 B1
(45) Date of Patent: Jul. 30, 2002

(54) IMAGE FORMING APPARATUS

(75) Inventors: Hiroyuki Arakawa, Abiko; Yasuo Nami, Toride, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/395,927

(22) Filed: Sep. 14, 1999

(30) Foreign Application Priority Data

Sep. 22, 1998 (JP) ..... 10-285955

(51) Int. Cl.[7] ..... G03G 15/20; G03G 21/00
(52) U.S. Cl. ..... 399/327; 399/45
(58) Field of Search ..... 399/327, 326, 399/352, 43, 45, 71; 219/216; 15/256.51, 256.53, 209.1; 432/59, 60

(56) References Cited

U.S. PATENT DOCUMENTS 4,926,218 A * 5/1990 Fukao ..... 399/327
5,049,943 A 9/1991 Menjo et al. ..... 355/284
5,168,314 A * 12/1992 Gunji et al. ..... 399/327
5,452,065 A * 9/1995 Bell ..... 399/327
5,463,457 A 10/1995 Takeuchi et al. ..... 355/313
5,559,591 A * 9/1996 Kato et al. ..... 399/327
5,640,658 A 6/1997 Inoue et al. ..... 399/298
5,649,130 A * 7/1997 Nakajima et al. ..... 399/327
5,848,341 A * 12/1998 Watanabe ..... 399/352
5,850,588 A * 12/1998 Yoshikawa ..... 399/327
5,930,574 A * 7/1999 Segawa ..... 399/327
5,970,298 A * 10/1999 Seki et al. ..... 399/327
5,978,640 A * 11/1999 Segawa ..... 399/327
5,999,786 A * 12/1999 Saito et al. ..... 399/327

FOREIGN PATENT DOCUMENTS

JP 09-080956 * 3/1997

* cited by examiner

*Primary Examiner*—Sophia S. Chen
(74) *Attorney, Agent, or Firm*—Fitzpatrick, Cella, Harper & Scinto

(57) ABSTRACT

In an image forming apparatus, during a continuous image forming mode, in a case where the number of recording members on which to form an image is not less than a predetermined number, a cleaning web is wound by a second amount larger than a first amount which is used for the ordinary winding of the cleaning web, after completion of a continuous image forming operation. Thus, a recording member to be next used for image formation can be prevented from being smudged.

19 Claims, 6 Drawing Sheets

IMAGE FORMING APPARATUS

BACKGROUND OF THE INVENTION

1. Field of the Invention

The present invention relates to an image forming apparatus of the kind using an electrophotographic method or an electrostatic recording method, such as an electrophotographic copying machine, a facsimile set, a printer or the like, and more particularly, to the method for cleaning a fixing device used for such an image forming apparatus.

2. Description of Related Art

Image forming apparatuses such as electrophotographic copying machines are generally provided with a web cleaning device having a cleaning web which is made of a nonwoven cloth or the like for cleaning and removing a residual toner left on an object to be cleaned such as a fixing roller.

FIG. 6 shows, by way of example, a conventional fixing device arranged to fix, by heating, a toner image T formed by the electrophotographic method to a transfer member P which is employed as a recording member. The fixing device shown in FIG. 6 is provided with a fixing roller 101 which is a fixing rotary body having a heating heater 103 such as a halogen heater disposed inside thereof. The fixing roller 101 is arranged to be rotated in the direction of an arrow by a driving force of a driving motor (not shown).

A pressure roller 102, which is supported by a bearing (not shown) below the fixing roller 101, is caused by some known pressing means to be in pressed contact with the fixing roller 101 at least in carrying out a fixing process. The rollers 101 and 102 are thus arranged to rotate in a state of being in pressed contact with each other.

A thermo-sensitive element 104 such as a thermistor or a thermocouple is disposed in contact with the outer circumferential surface of the fixing roller 101. The thermo-sensitive element 104 is thus arranged to detect the temperature of the fixing roller 101 and to send a detection signal to some known control means. The control means is arranged to control the output of the heater 103 or a voltage applied to the heater 103 on the basis of the detection signal of the thermo-sensitive element 104, so that the outer circumferential surface of the fixing roller 101 is kept at a toner-image fusing temperature.

Separation claws 151 and 152 are disposed in contact respectively with the fixing roller 101 and the pressure roller 102 and are arranged to reliably separate the transfer member P from the rollers 101 and 102 after a fixing process. The separation claws 151 and 152 are made of a heat resisting resin, such as a polyimide or polyamide resin, coated with a fluororesin.

Meanwhile, a cleaning device 106 is disposed above the fixing roller 101 to remove an offset toner and a foreign matter such as paper powder or the like sticking to the surface of the fixing roller 101. The cleaning device 106 uses a cleaning web (hereinafter referred to simply as the web) 160 which is a band-shaped element made of a heat resisting nonwoven cloth, such as Nomex (trade name), Himelon (trade name), etc.

Further, a web pressing roller 165 is rotatably supported by a bearing 172 at each of its two ends. The offset toner and foreign matter such as paper powder or the like sticking to the surface of the fixing roller 101 are removed from the surface of the fixing roller 101 and are thus effectively prevented from offsetting, with the web pressing roller 165 arranged to be in pressed contact with the fixing roller 101.

Generally, the web 160 is arranged to be wound, or taken up, as much as a predetermined amount per sheet of copy by a driving means (not shown), irrespective as to whether the image forming apparatus is in the mode of copying (printing) a single sheet or in the mode of continuously copying a plurality of sheets.

The above-stated fixing device has almost no offset caused by slipping-off of an offset toner from the web 160 while copying (printing) is in process. This is because only a very small amount of toner slips off being not captured by the web 160 in the process of copying. Besides, the slip-off toner, coming into contact with both the fixing roller 101 and the pressure roller 102, is dispersed on the surfaces of both the fixing roller 101 and the pressure roller 102 to evenly flow out little by little to the surface and back sides of the transfer member P during the copying process. The slip-off toner is, therefore, hardly notable while copying is in process.

On the other hand, when the rollers 101 and 102 are caused to rotate immediately after the start of the image forming apparatus, or when copying is resumed after a pause, however, some residual toner is not completely captured by the web 160 and is allowed to slip off. The slip-off toner then might come out in lumps to stick to the recording member, i.e., the transfer member P, to conspicuously smudge the recording member. Further, if the slip-off toner on the fixing roller 101 comes into contact with the pressure roller 102, the slip-off toner becomes solid on the pressure roller 102 to stick to the pressure roller 102, because the temperature of the pressure roller 102 is relatively low at this time. A major portion of the slip-off toner is thus transferred from the fixing roller 101 to the pressure roller 102.

When the transfer member P is fed under this condition, the majority of the slip-off toner on the pressure roller 102 is re-transferred to the back side of the transfer member P, which is inferior in parting property than the pressure roller 102. Therefore, a back-side smudged state of the transfer member P tends to stand out.

The smudge which results from offsetting becomes salient particularly when copying is restarted after a pause after completion of continuous copying, due to the following reason.

The fixing roller 101 is controlled and adjusted to be at a predetermined fixing temperature. However, in the case of continuous copying, the process of adjusting the temperature of the fixing roller 101 to the fixing temperature might gradually become too slow, depending on the number of sheets in continuous copying. The temperature of the fixing roller 101 then drops to deteriorate the fixing power of the fixing roller 101. As a result, the amount of toner offsetting on the surface of the fixing roller 101 comes to increase.

Further, in carrying out continuous copying to obtain a great number of copies of one and the same image, the offset toner concentrates in a position corresponding to the image. This also causes the offsetting smudge to become conspicuous after continuous copying.

The above phenomenon becomes conspicuous also in a case where the operation of the image forming apparatus is restarted after using such transfer members that are inferior in fixing property and thus tend to increase the amount of residual toner.

BRIEF SUMMARY OF THE INVENTION

It is an object of the invention to provide an image forming apparatus which is capable of preventing a recording member from being smudged by some offset toner when an image forming operation is performed after a pause after completion of a continuous image forming operation.

It is another object of the invention to provide an image forming apparatus in which, in a case where the number of recording members during a continuous image forming mode is not less than a predetermined number, a cleaning member moves by a second amount larger than a first amount after completion of a continuous image forming operation.

It is a further object of the invention to provide an image forming apparatus in which, after completion of an image forming operation, a cleaning member moves by an amount not less than the width of a part where a rotary member and the cleaning member are in contact with each other in a moving direction of the cleaning member.

The above and further objects and features of the invention will become apparent from the following detailed description of preferred embodiments thereof taken in conjunction with the accompanying drawings.

DETAILED DESCRIPTION OF THE INVENTION

Hereinafter, preferred embodiments of the invention will be described in detail with reference to the drawings.

Figure 1:
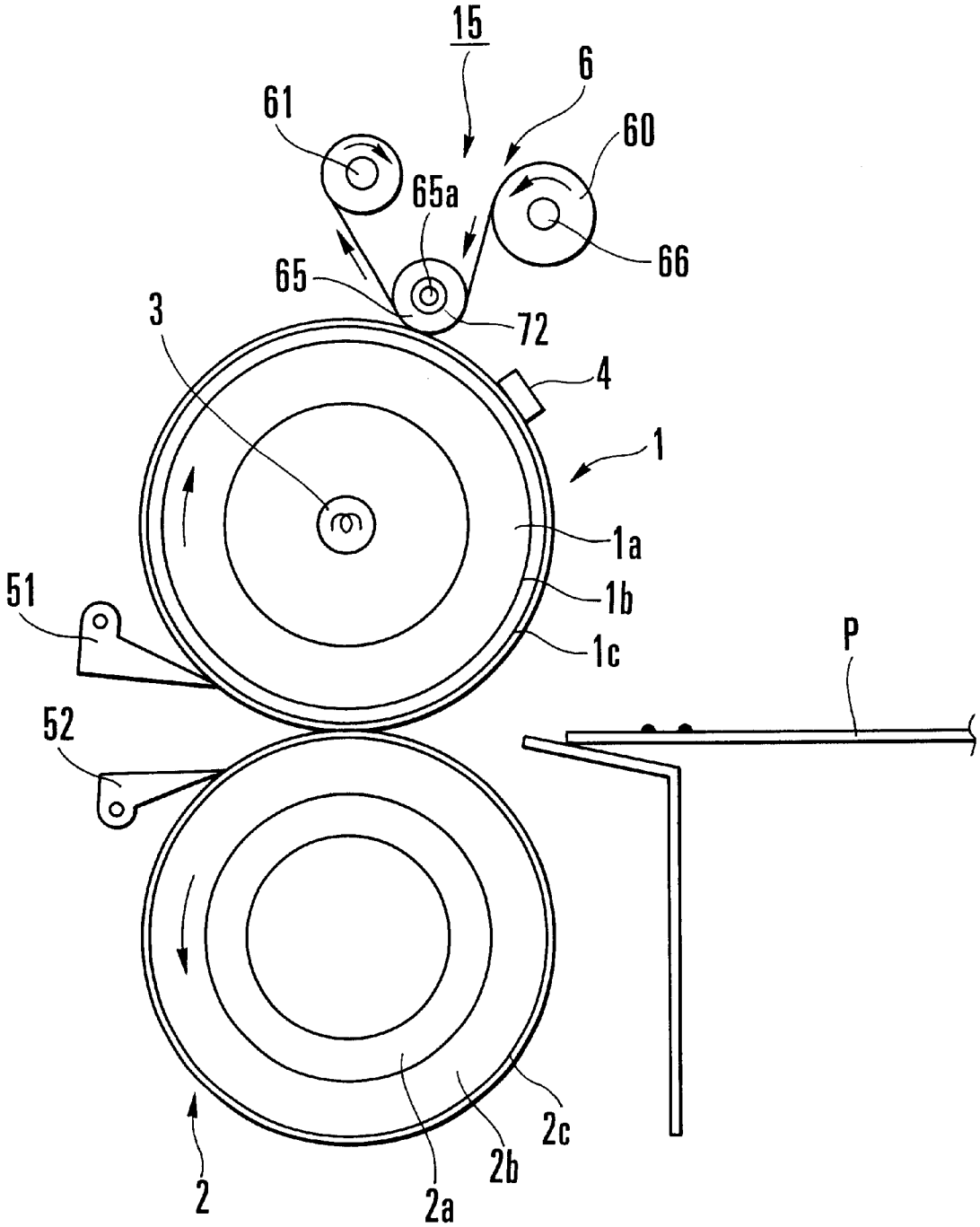
FIG. 1 is a diagram showing the structural arrangement of a fixing device according to a first embodiment of the invention.
Figure 2:
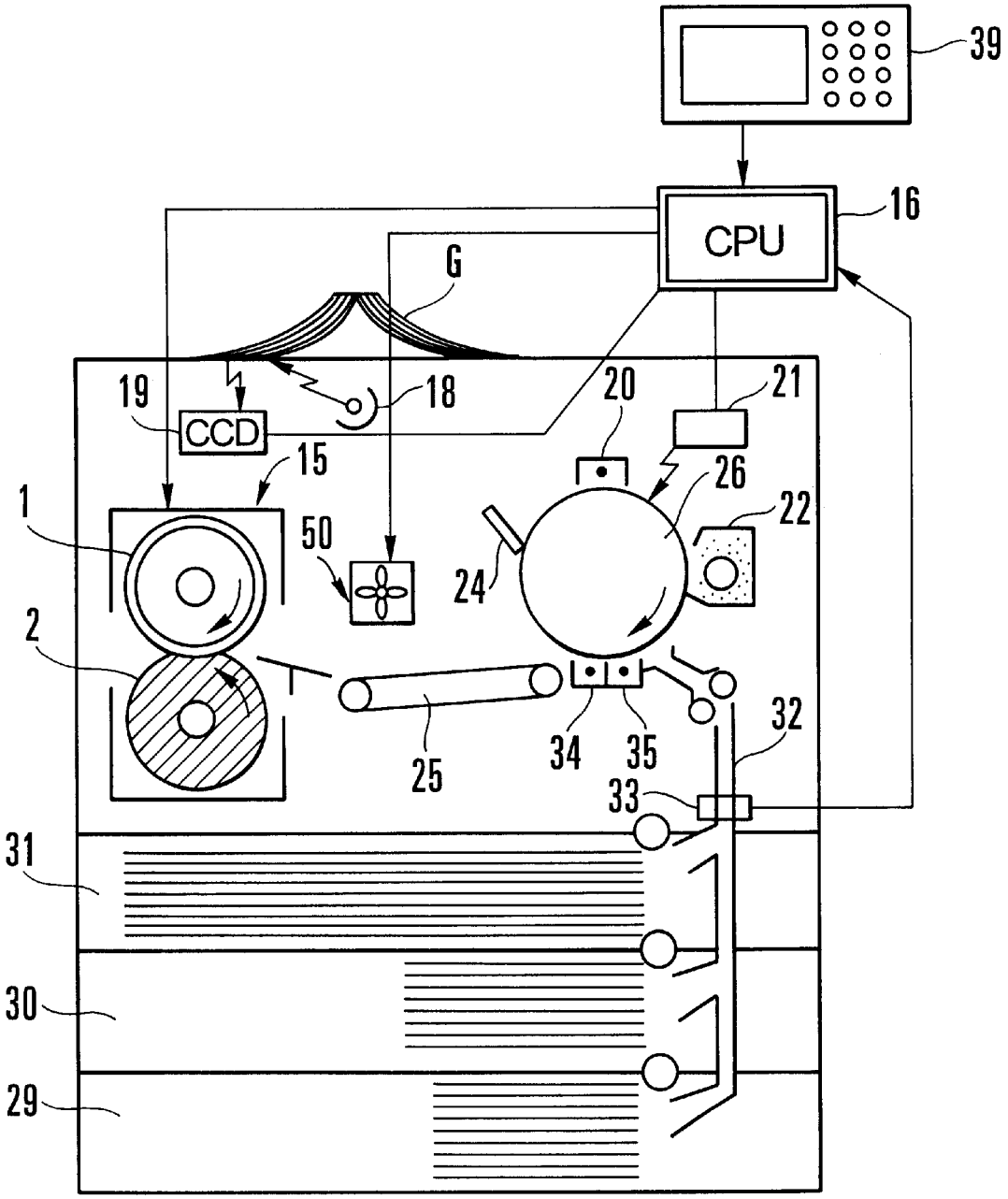
FIG. 2 is a schematic diagram showing the structural arrangement of an image forming apparatus according to the first embodiment of the invention.
Figure 3:
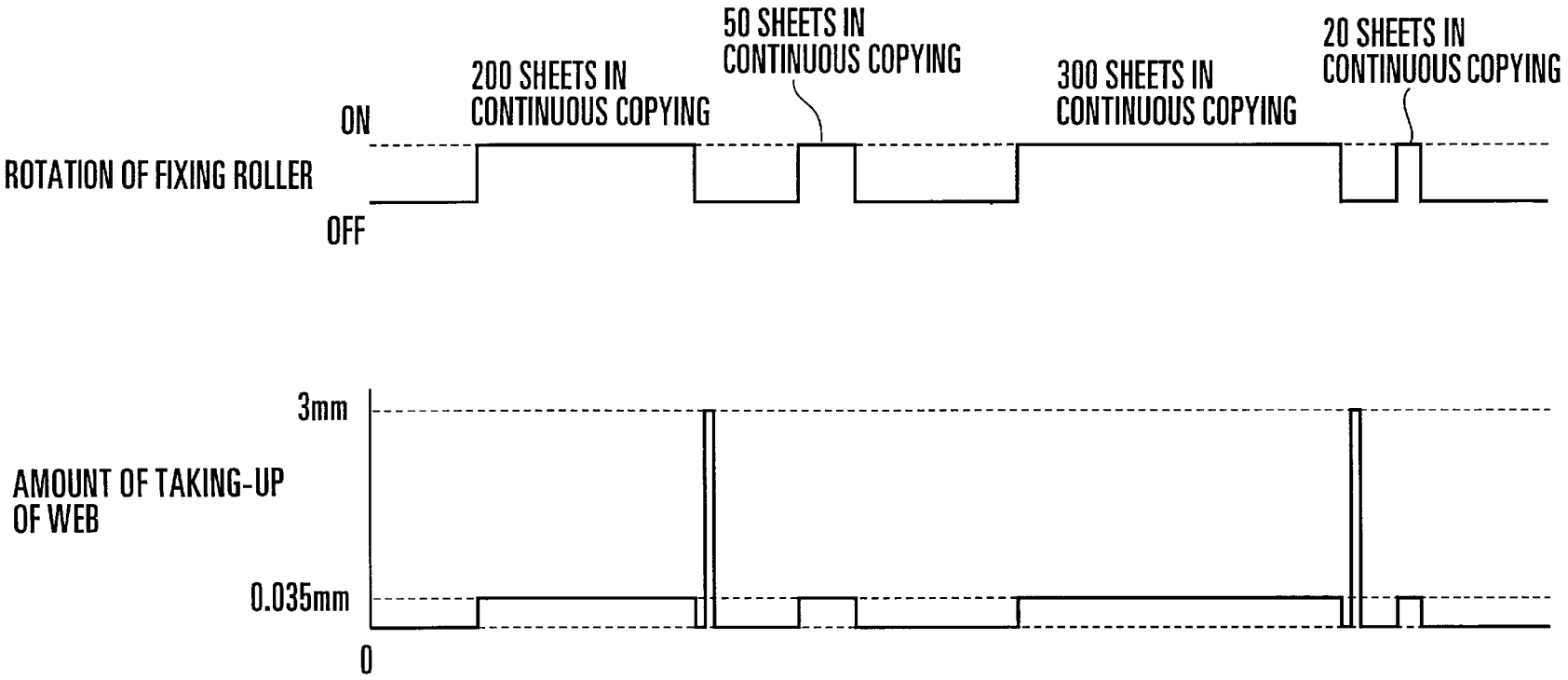
FIG. 3 is a timing chart showing control to be performed in the first embodiment of the invention.

FIGS. 1, 2 and 3 relate to a first embodiment of the invention.

First, referring to FIG. 2, an image forming apparatus of the electrophotographic type according to the first embodiment of the invention will be schematically described.

As shown in FIG. 2, the image forming apparatus according to the first embodiment is an electrophotographic copying machine. An original G is scanned with light emitted from a light source 18. The reflected light from the original G is imaged on a CCD (charge-coupled device) 19. An electrical signal from the CCD 19 is supplied to a CPU (central processing unit) 16, which is a control device, to be processed by an internal signal processing circuit of the CPU 19. In accordance with the processed signal, a laser beam from a laser 21 illuminates the surface of a photosensitive drum 26, which is uniformly charged with electricity by a charging device 20. A latent image is thus formed on the surface of the photosensitive drum 26.

The latent image formed on the surface of the photosensitive drum 26 is developed as a toner image by a developing device 22. The toner image thus developed is transferred by the action of a transfer charger 35 to a transfer member P, serving as a recording member, which has been transported from a paper feeding cassette 29, 30 or 31 through a transport path 32. The transfer member P is separated by a separation charger 34 from the photosensitive drum 26 and is then transported to a fixing device 15 through a conveyer belt 25. At the fixing device 15, the toner image transferred to the transfer member P is fixed by heating and pressing. Then, some of toner which remains on the photosensitive drum 26 is removed by a cleaning blade 24.

The CPU 16 in the first embodiment is arranged to control not only the CCD 19 and the laser 21 but also the timing of a sequence of image forming processes, such as forming the toner image on the photosensitive drum 26, transferring the toner image and separating the transfer member by the transfer and separation chargers 34 and 35, and fusing and fixing the toner image on the transfer member by the fixing device 15. The CPU 16 further controls the operation of a fan 50, which is provided for controlling environment within the image forming apparatus. In FIG. 2, reference numeral 39 denotes an operation panel.

The image forming apparatus according to the first embodiment is capable of selecting a continuous image forming mode. In the continuous image forming mode, the number of sheets in copying is set as desired on the operation panel 39. Then, a continuous image forming operation, i.e., continuous copying, can be performed by pushing a copying button. The term "continuous image forming" means an operation of forming an image or images continuously on a plurality of recording members by giving, only once, a command for a start of image forming.

The details of the fixing device 15 according to the first embodiment are next described with reference to FIG. 1.

Referring to FIG. 1, the fixing device 15 is provided with a fixing roller 1 which is a fixing rotary body having a heating heater 3 such as a halogen heater disposed inside thereof. The fixing roller 1 is arranged to be rotated in the direction of an arrow by a driving force of a driving motor (not shown).

A pressure roller 2, which is supported by a bearing (not shown) below the fixing roller 1, is caused by some known pressing means to be in pressed contact with the fixing roller 1 at least in carrying out a fixing process. The rollers 1 and 2 are thus arranged to rotate in a state of being in pressed contact with each other. At this pressed contact part, i.e., a nip part, the recording member which bears an unfixed toner image, i.e., a toner image which has not been fixed as yet, is conveyed in a state of being pinched between the fixing roller 1 and the pressure roller 2 to have the unfixed toner image fixed to the recording member.

The fixing roller 1 is composed of a hollow metal core 1*a* which is made of aluminum, stainless steel, or iron, a heat resisting elastic layer 1*b* which is formed along the outer circumference of the core 1*a* to measure about 0.1 to 1 mm in thickness, and a resin layer 1*c* which is formed, as a mold-parting layer, further on the outer side of the elastic layer 1*b* to measure about 1.0 to 40 $\mu$m in thickness.

The pressure roller 2 is composed of a metal roller core 2*a*, a relatively thick (for example, 5 to 10 mm in thickness) elastic layer 2*b* which is formed with a silicone rubber, a fluororubber or a fluoro-silicone rubber on the outer circumference of the metal core 2*a*, and a fluororesin layer 2*c* which is formed, as a mold-parting layer, further on the outer side of the elastic layer 2*b* to measure 30 to 50 $\mu$m or thereabout in thickness.

A thermo-sensitive element 4 such as a thermistor or a thermocouple is disposed in contact with the outer circumferential surface of the fixing roller 1. The thermo-sensitive element 4 is thus arranged to detect the temperature of the fixing roller 1 and to send a detection signal to some known control means. The control means is arranged to control the output of the heater 3 or a voltage applied to the heater 3 on the basis of the detection signal of the thermo-sensitive element 4, so that the outer circumferential surface of the fixing roller 1 is kept at a toner-image fusing temperature.

Separation claws 51 and 52 are disposed in contact respectively with the fixing roller 1 and the pressure roller 2 and are arranged to reliably separate the transfer member P from the rollers 1 and 2 after a fixing process. The separation claws 51 and 52 are made of a heat resisting resin, such as a polyimide or polyamide resin, coated with a fluororesin.

Meanwhile, a cleaning device 6 is disposed above the fixing roller 1 to remove an offset toner and a foreign matter such as paper powder or the like sticking to the surface of the fixing roller 1.

The cleaning device 6 is provided with a supply shaft 66 around which a cleaning web (hereinafter referred to simply as the web) 60, serving as a cleaning member, is wound in a coil, a take-up shaft 61 arranged to take up the web 60 thereon, and a web pressing roller 65 which is arranged between the two shafts 61 and 66 to press the web 60 against the surface of the fixing roller 1.

The web 60 is made of a heat resisting nonwoven cloth, such as Nomex (trade name), Himelon (trade name) or the like, generally arranged as follows. The nonwoven cloth is formed to be strong and yet to have a suitable degree of softness by having a polyester fiber which is soft at a high temperature mixed with an aromatic polyamide fiber. Then, the nonwoven cloth is impregnated with a silicone oil having viscosity of about 10,000 centistokes or thereabout before it is wound into a coil.

The web pressing roller 65 is rotatably supported at each of its two ends by a bearing 72. With the web pressing roller 65 kept in pressed contact with the fixing roller 1, an offset toner and foreign matters such as a paper powder, etc., sticking to the surface of the fixing roller 1 are removed from the surface of the fixing roller 1, thereby preventing any offset smudge.

The web pressing roller 65 is formed by coating a metal core 65*a* with a heat resisting rubber layer, such as a silicone rubber. In order to obtain a sufficient degree of softness, the rubber layer is arranged to be in a spongy form by incorporating a foaming agent in the rubber. The hardness rate of the rubber is thus arranged to be 10 to 20 degrees (Asker-C).

The web 60 is arranged to be taken up as much as a predetermined amount (first amount) per sheet of the recording member in synchronism with an image forming operation, i.e., a copying operation.

The first embodiment is characterized by the method of control over the web take-up shaft 61 which is arranged to be controlled by the CPU 16 shown in FIG. 2.

A control sequence for the web take-up shaft 61 is arranged such that, in a case where the operation panel 39 is operated to set the number of sheets in continuous copying (printing) to 200 or more sheets, the take-up shaft 61 is actuated to take up a predetermined amount (second amount) of the web 60 thereon when the fixing roller 1 comes to a stop after completion of the continuous copying. In taking up the web 60, any residual toner left between the web 60 and the fixing roller 1 is removed by being also taken up along with the web 60.

More specifically, during the process of continuous copying, the web 60 is fed for cleaning as much as 0.035 mm (first amount) per sheet of A4 size paper. However, in a case where 200 or more sheets are subjected to continuous copying, the web 60 is further wound or taken up as much as 1 to 10 mm (second amount) when the fixing roller 1 comes to a stop after completion of the continuous copying. In the case of the first embodiment, the amount of the web 60 to be further taken up is arranged to be 3 mm.

FIG. 3 is a timing chart showing the rotation sequence of the web take-up shaft 61 in the first embodiment.

As shown in FIG. 3, when the fixing roller 1 stops rotating after a continuous copying action is performed to obtain 200 or 300 sheets of copy, the web 60 is taken up as much as 3 mm by rotating the take-up shaft 61 respectively in these cases. On the other hand, the web 60 is not taken up when the fixing roller 1 stops rotating after a continuous copying action is performed to obtain 50 or 20 sheets of copy.

The first embodiment was subjected to tests in comparison with the conventional device. Each of the tests was conducted to continuously copy a prescribed chart on 300 sheets of A4 size paper at a rate of 50 sheets/min and at an ambient temperature of 15° C., to pause for one minute after that, and then to continuously pass five sheets. After the tests, a check was made for offset smudge.

Further, the amount of the web to be fed after the continuous copying was set to 1 mm, 3 mm, 5 mm and 10 mm.

The test results were shown in Table 1 below:

TABLE 1

| | Web feeding amount after continuous copying | Offset | Maximum web using amount in embodiment |
|---|---|---|---|
| Conventional device: | 0 mm | × | — |
| First embodiment: | 1 mm | Δ | 1.25 m |
| | 3 mm | ○ | 3.75 m |
| | 5 mm | ○ | 6.25 m |
| | 10 mm | ○ | 12.5 m |

○: No offset smudge was generated.
Δ: Offset smudge was slightly generated.
×: Offset smudge was badly generated.

As shown in Table 1, the first embodiment of the invention effectively prevents a recording member from being smudged when copying is resumed after a pause after completion of the continuous copying.

The amount of taking up the web after completion of the continuous copying is preferably at least equal to a nip taking place between the web 60 and the fixing roller 1 (width of contact as viewed in a sectional view). In the case of the first embodiment, the nip is 3 mm and, therefore, the amount of taking up the web after completion of the continuous copying is 3 mm.

Meanwhile, the arrangement for taking up the web 60 by a predetermined amount when the fixing roller 1 comes to a stop after completion of the continuous copying tends to shorten the service life of the web 60. However, with a warranted service life of the web 60 assumed to be 250 thousand sheets by using 0.035 mm of the web 60 per copy sheet, if the length of the coiled web 60 to be used is assumed to be 12.5 m, the web 60 leaves a margin of 3.75 m. Therefore, with the web 60 arranged to be taken up as much as 3 mm every time the fixing roller 1 comes to a stop after completion of the continuous copying of at least 200 sheets, the arrangement brings about no problem, because it increases the web using amount only by 3.75 m at the most.

As has been described above, in the fixing device and the image forming apparatus according to the first embodiment, in a case where the number of copies in continuous copying is set to a predetermined number or more, a band-shaped web is wound or taken up by a predetermined amount after a fixing rotary body comes to a stop after completion of the continuous copying. Therefore, even when copying is resumed after a pause after completion of the continuous copying, it is possible to prevent any offset smudge from being generated, so that a high-quality image can be formed.

A second embodiment of the invention will be next described below with reference to FIG. 4.

In the second embodiment, the invention is applied to an image forming apparatus and a fixing device arranged similar to the first embodiment. The second embodiment is characterized in the following point. In a case where the operation panel 39 is operated to set the number of sheets in continuous copying to 200 or more sheets, the thickness of each transfer member in process of continuous copying is detected by means of a thickness sensor 33. If the average thickness of the transfer members is found to be 80 μm or more, the amount by which the web 60 is taken up when the fixing roller 1 comes to a stop after completion of the continuous copying is arranged to be larger than an amount set for transfer members of thickness less than 80 μm.

Figure 4:
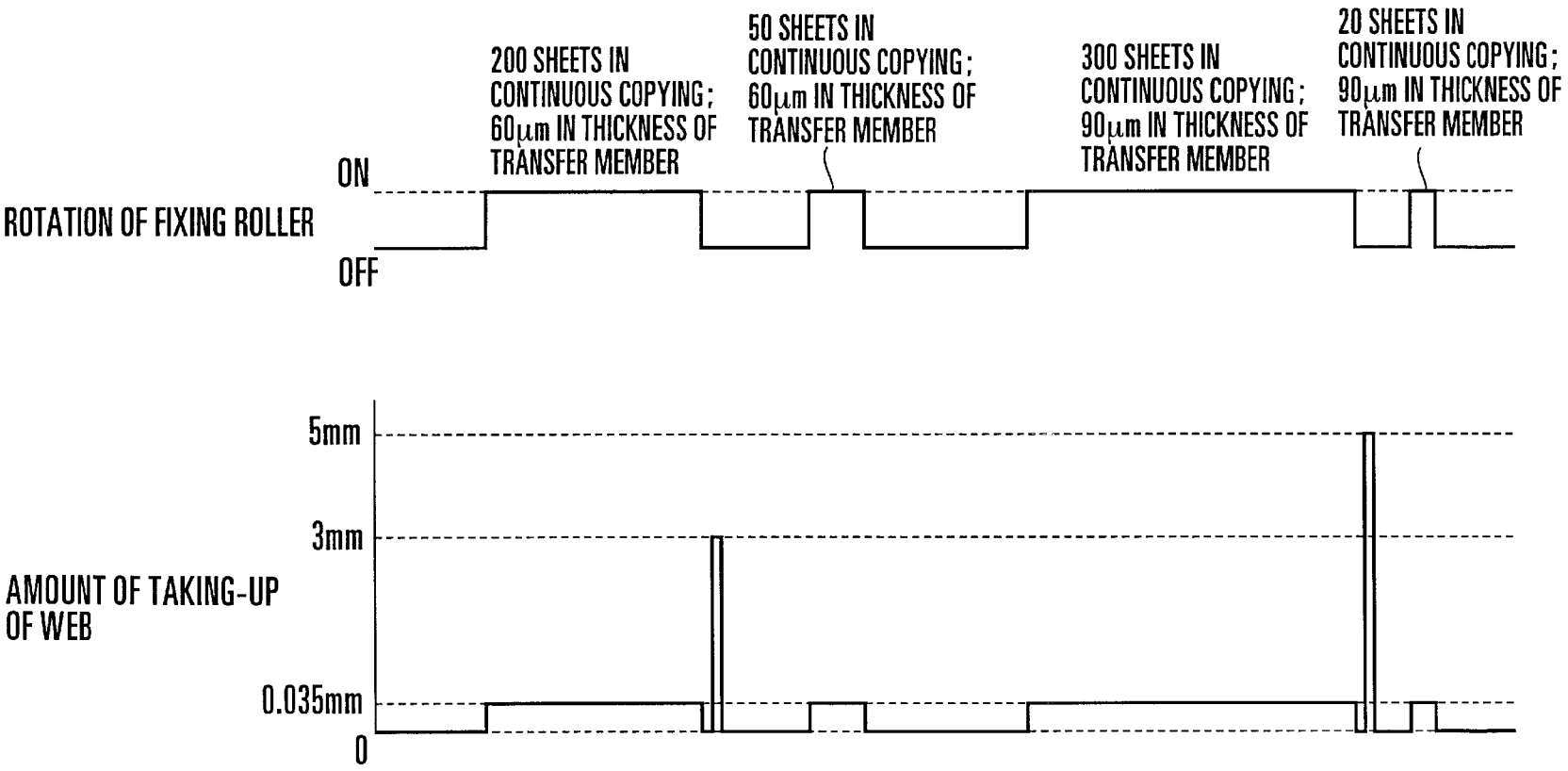
FIG. 4 is a timing chart showing control to be performed in a second embodiment of the invention.

More specifically, as shown by way of example in the timing chart of FIG. 4, if the continuous copying is to be made to obtain 200 sheets of copy which measure 60 μm in thickness on an average, the web 60 is taken up as much as 3 mm after completion of the continuous copying. In a case where the continuous copying is to be made to obtain 300 sheets of copy which measure 90 μm in thickness on an average, the web 60 is taken up as much as 5 mm after completion of the continuous copying. However, the web 60 is not further taken up in cases where the continuous copying is to be made either for 50 sheets measuring 60 μm in thickness on an average or 20 sheets measuring 90 μm in thickness on an average.

The second embodiment was subjected to tests which were conducted in the same manner as in the case of the first embodiment. The results were as shown in Table 2 below:

TABLE 2

| Average thickness of 300 transfer members in continuous continuous copying | Web feeding amount after continuous copying | Offset | Maximum web using amount in embodiment |
|---|---|---|---|
| Conventional device: | 0 mm | × | — |
| — | | | |
| Second embodiment: | | | |
| 60 μm | 1 mm | Δ | 1.25 m |
| | 3 mm | ○ | 3.75 m |
| | 5 mm | ○ | 6.25 m |
| | 10 mm | ○ | 12.5 m |
| 90 μm | 1 mm | × | 1.25 m |
| | 3 mm | Δ | 3.75 m |
| | 5 mm | ○ | 6.25 m |
| | 10 mm | ○ | 12.5 m |

○: No offset smudge was generated.
Δ: Offset smudge was slightly generated.
×: Offset smudge was badly generated.

As apparent from Table 2 above, compared with the conventional device, the second embodiment is also capable of preventing a recording member from being smudged when copying is resumed after a pause after completion of the continuous copying.

More specifically, in continuously copying a predetermined number of sheets of copy, use of thick transfer members which are inferior in fixing property causes a larger amount of residual toner than use of thin transfer members. Therefore, the second embodiment is arranged to have a larger amount of the web taken up when the fixing roller comes to a stop after continuous copying on thick transfer members than on thin transfer members. This arrangement effectively enables the second embodiment to suppress any smudge from taking place when the copying operation is resumed. Further, as mentioned above, the amount of taking up the web after completion of the continuous copying is arranged to be 3 mm if the thickness of the transfer member is less than 80 μm and to be 5 mm if the thickness of the transfer member is 80 μm or more.

As mentioned above, the arrangement for taking up the web 60 by a predetermined amount when the fixing roller 1 comes to a stop after completion of the continuous copying tends to shorten the service life of the web 60. However, with a warranted service life of the web 60 assumed to be 250 thousand sheets by using 0.035 mm of the web 60 per copy sheet, if the length of the coiled web to be used is assumed to be 15 m, the web 60 leaves a margin of 6.25 m. Therefore, with the web 60 arranged to be taken up as much as 5 mm for thick transfer members and as much as 3 mm for thin transfer members, every time the fixing roller 1 comes to a stop after completion of the continuous copying of at least 200 sheets, the arrangement brings about no problem, because it increases the web using amount only by 6.25 m at the most.

A third embodiment of the invention will be next described below with reference to FIG. 5.

In the third embodiment, the invention is applied to an image forming apparatus and a fixing device arranged similar to the first embodiment. The third embodiment is characterized in the following point. In a case where the operation panel 39 is operated to set the number of sheets in continuous copying to 200 or more sheets, if a paper feeding cassette selected at the operation panel 39 is a cassette 29 dedicated to thick sheets of paper, the web 60 is taken up, when the fixing roller 1 comes to a stop after completion of the continuous copying, by a larger amount than in the case of other paper feeding cassettes 30 and 31 which contain thin sheets of paper.

Figure 5:
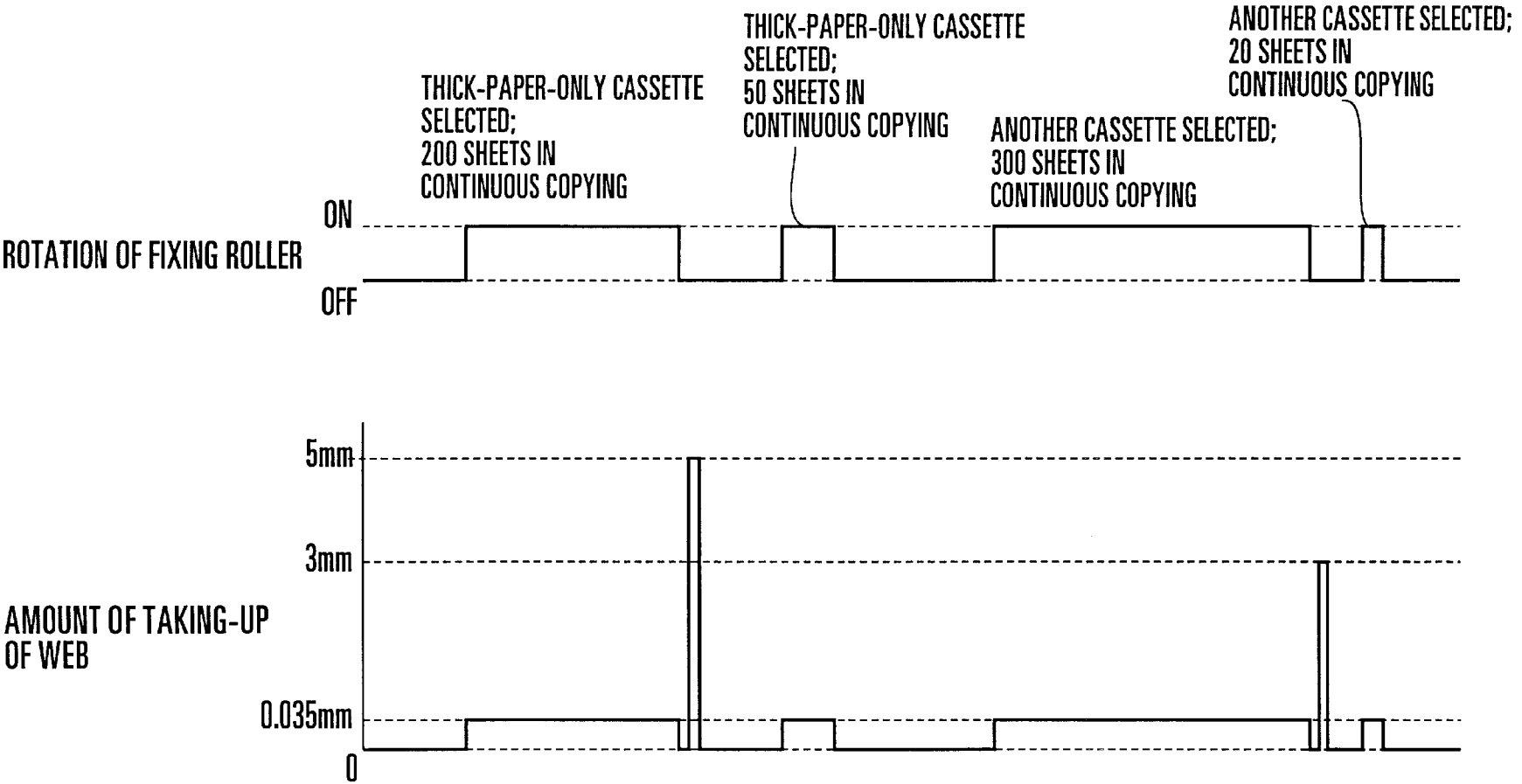
FIG. 5 is a timing chart showing control to be performed in a third embodiment of the invention.
Figure 6:
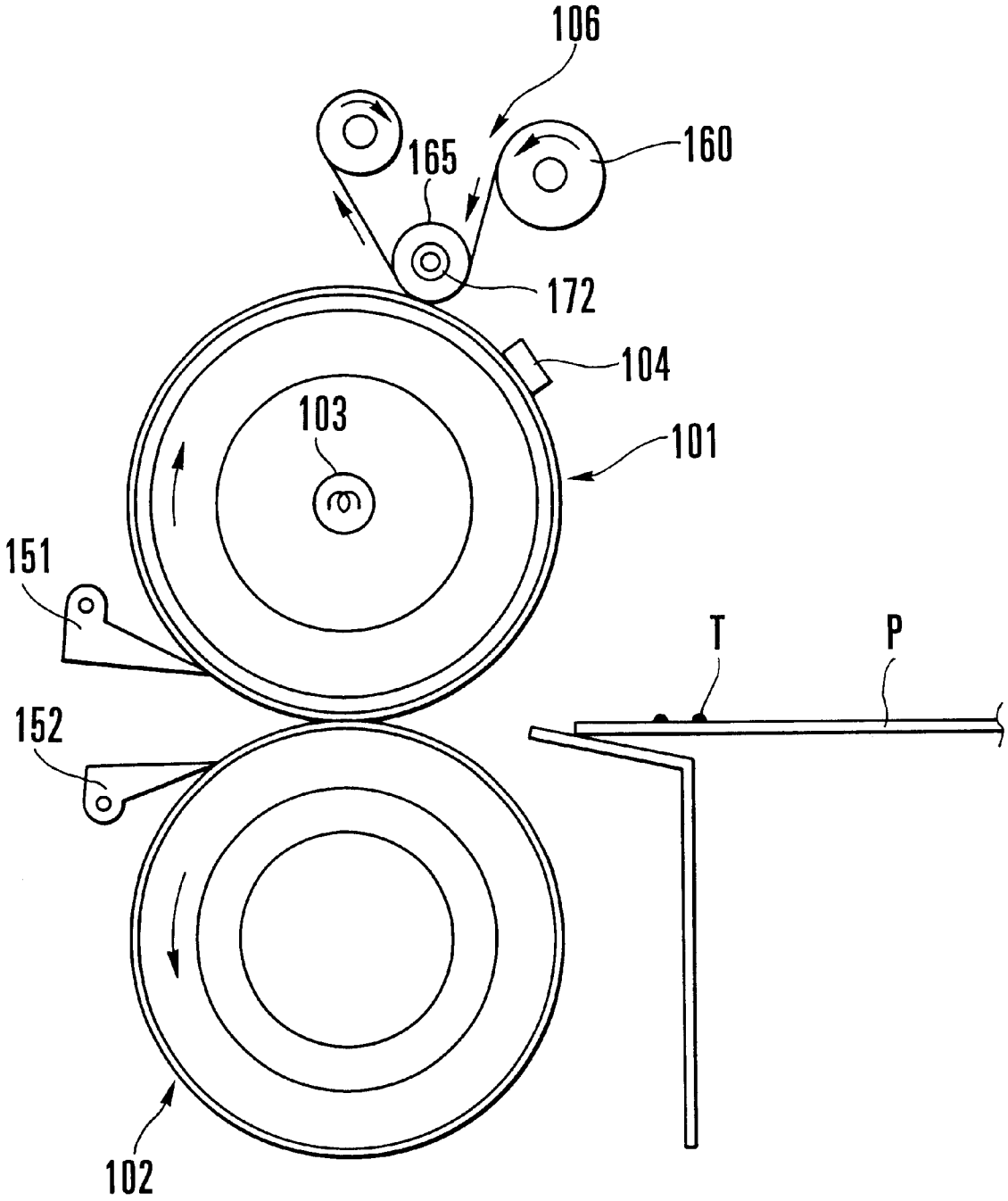
FIG. 6 is a diagram showing, by way of example, the structural arrangement of a conventional fixing device.

FIG. 5 is a timing chart showing a rotation sequence of the web take-up shaft 61 in the third embodiment. Referring to FIG. 5, in a case where a thick-paper-only cassette is selected and the continuous copying is performed to obtain 200 sheets of copy, the web 60 is taken up as much as 5 mm when the fixing roller 1 comes to a stop after completion of the continuous copying. In another case where some other cassette is selected and the continuous copying is performed to obtain 300 sheets, the web 60 is taken up as much as 3 mm when the fixing roller 1 comes to a stop after completion of the continuous copying. On the other hand, the web 60 is not further taken up even with the thick-paper-only cassette selected if the number of sheets of copy to be obtained by continuous copying is 50 sheets. The web 60 is also not further taken up, with some other cassette selected, if the number of sheets in continuous copying is 20 sheets.

The third embodiment was subjected to tests which were conducted in the same manner as in the case of the first embodiment. The test results were as shown in Table 3 below:

TABLE 3

| Cassette selected in continuous copying of 300 sheets | Web feeding amount after continuous copying | Offset | Maximum web using amount in embodiment |
|---|---|---|---|
| Conventional device: — | 0 mm | × | — |
| Third embodiment: | | | |
| Thick-paper-only cassette | 1 mm | × | 1.25 m |
| | 3 mm | Δ | 3.75 m |
| | 5 mm | ○ | 6.25 m |
| | 10 mm | ○ | 12.5 m |
| Other cassettes | 1 mm | Δ | 1.25 m |
| | 3 mm | ○ | 3.75 m |
| | 5 mm | ○ | 6.25 m |
| | 10 mm | ○ | 12.5 m |

○: No offset smudge was generated.
Δ: Offset smudge was slightly generated.
×: Offset smudge was badly generated.

As apparent from Table 3 above, compared with the conventional device, the third embodiment is also capable of preventing a recording member from being smudged when copying is resumed after completion of the continuous copying.

More specifically, the use of a paper feeding cassette dedicated to thick transfer members which are inferior in fixing property causes a larger amount of residual toner than use of other paper feeding cassettes. The third embodiment is, therefore, arranged to have a larger amount of the web 60 taken up when the fixing roller 1 comes to a stop after completion of the continuous copying with the cassette of this type than with some other cassettes. This arrangement enables the third embodiment to effectively suppress any smudge from taking place when the copying operation is resumed.

Unlike the second embodiment, the arrangement of the third embodiment dispenses with the thickness sensor. Therefore, the third embodiment can be more simply arranged to permit reduction in cost.

As mentioned above, the arrangement for taking up the web 60 by a predetermined amount when the fixing roller 1 comes to a stop after completion of the continuous copying tends to shorten the service life of the web 60. However, with a warranted service life of the web 60 assumed to be 250 thousand sheets by using 0.035 mm of the web 60 per copy sheet, if the length of the coiled web 60 to be used is assumed to be 15 m, the web 60 leaves a margin of 6.25 m. Therefore, with the web 60 arranged to be taken up as much as 5 mm for a thick-paper-only feeding cassette and as much as 3 mm for a thin-paper-only feeding cassette, every time the fixing roller 1 comes to a stop after completion of the continuous copying of 200 sheets or more, the arrangement brings about no problem, because it increases the web using amount only by 6.25 m at the most.

In the cases of the embodiments described above, a reference number of sheets of continuous copying which necessitates the web to be further taken up (wound) after the continuous copying is preset at 200. However, this number of sheets is variable as desired according to the degree of smudge.

Further, in a case where the web is available in an ample amount, the web may be arranged to be taken up to an extent exceeding the width of contact of the web with the fixing roller every time an image forming operation is performed. The same advantageous effect as that of each embodiment described above can be attained by such an arrangement.

While the preferred embodiments have been described by way of example in the foregoing, the invention is not limited to the disclosed embodiments. The invention is intended to cover all modifications and equivalent arrangements that are within the technological spirit thereof.

What is claimed is:

1. An image forming apparatus comprising:

unfixed image forming means for forming an unfixed image on a recording member;

a rotary member for fixing, by heating, the unfixed image formed by said unfixed image forming means onto the recording member; and a cleaning member for cleaning said rotary member in a state of being in contact with said rotary member, said cleaning member being arranged to move by a first amount in synchronism with an image forming operation, wherein said image forming apparatus has a continuous image forming mode of continuously forming an image on a plurality of recording members, and wherein, during the continuous image forming mode, in a case where the number of recording members on which to form an image is not less than a predetermined number, said cleaning member moves by a second amount larger than said first amount after completion of a continuous image forming operation.

2. An image forming apparatus according to claim 1, wherein said second amount is not less than a width of a part where said cleaning member is in contact with said rotary member in a moving direction of said cleaning member.

3. An image forming apparatus according to claim 1, wherein said second amount varies according to kind of the recording member.

4. An image forming apparatus according to claim 1, wherein said second amount varies according to thickness of the recording member.

5. An image forming apparatus according to claim 4, further comprising detection means for detecting the thickness of the recording member.

6. An image forming apparatus according to claim 4, further comprising a cassette arranged to contain therein recording members so as to supply the recording member to said unfixed image forming means, the thickness of the recording member being determined on the basis of said cassette.

7. An image forming apparatus according to claim 1, wherein said cleaning member moves in such a way as to bring an unused part thereof into contact with said rotary member.

8. An image forming apparatus according to claim 1, wherein said cleaning member is in a web-like shape and is arranged to be wound in one direction.

9. An image forming apparatus according to claim 1, wherein said rotary member is a fixing roller having a heater disposed inside thereof and said image forming apparatus further comprises a pressure roller arranged to form a nip between said fixing roller and said pressure roller, and wherein the recording member bearing the unfixed image is transported in a state of being pinched at said nip so as to have the unfixed image fixed onto the recording member.

10. An image forming apparatus according to claim 1, wherein said rotary member continuously rotates during process of the continuous image forming operation.

11. An image forming apparatus according to claim 1, wherein said rotary member stops rotating, simultaneously with completion of the continuous image forming operation.

12. An image forming apparatus comprising:

unfixed image forming means for forming an unfixed image on a recording member;

a rotary member for fixing, by heating, the unfixed image formed by said unfixed image forming means onto the recording member; and a cleaning member for cleaning said rotary member in a state of being in contact with said rotary member, wherein said cleaning member moves by a predetermined amount after completion of an image forming operation, wherein said predetermined amount is not less than a width of a contacting portion where said cleaning member is in contact with said rotary member in a moving direction of said cleaning member, and wherein said predetermined amount varies according to a kind of the recording member.

13. An image forming apparatus comprising:

unfixed image forming means for forming an unfixed image on a recording member;

a rotary member for fixing, by heating, the unfixed image formed by said unfixed image forming means onto the recording member;

a cleaning member for cleaning said rotary member in a state of being in contact with said rotary member, and wherein said cleaning member moves by a predetermined amount after completion of an image forming operation, wherein said predetermined amount is not less than a width of a contacting portion where said cleaning member is in contact with said rotary member in a moving direction of said cleaning member, and wherein said predetermined amount varies according to a thickness of the recording member.

14. An image forming apparatus according to claim 13, further comprising detection means for detecting the thickness of the recording member.

15. An image forming apparatus according to claim 13, further comprising a cassette arranged to contain therein recording members so as to supply the recording member to said unfixed image forming means, the thickness of the recording member being determined on the basis of said cassette.

16. An image forming apparatus according to claim 12 or 13, wherein said cleaning member moves in such a way as to bring an unused part thereof into contact with said rotary member.

17. An image forming apparatus according to claim 12 or 13, wherein said cleaning member is in a web-like shape and is arranged to be wound in one direction.

18. An image forming apparatus claim 12 or 13, wherein said rotary member is a fixing roller having a heater disposed inside thereof and said image forming apparatus further comprises a pressure roller arranged to form a nip between said fixing roller and said pressure roller, and wherein the recording bearing the unfixed image is transported in a state of being pinched at said nip so as to have the unfixed image fixed onto the recording member.

19. An image forming apparatus claim 12 or 13, wherein said rotary member stops rotating, simultaneously with completion of the image forming operation.

* * * * *

UNITED STATES PATENT AND TRADEMARK OFFICE

CERTIFICATE OF CORRECTION

PATENT NO. : 6,427,060 B1
DATED : July 30, 2002
INVENTOR(S) : Hiroyuki Arakawa et al.

It is certified that error appears in the above-identified patent and that said Letters Patent is hereby corrected as shown below:

Column 4,
Line 5, “conveyer” should read -- conveyor --.
Line 8, “toner” should read -- the toner --.
Line 35, “heating” should be deleted.

Column 8,
Line 20, “250 thousand” should read -- 250,000 --.

Column 9,
Line 45, “250 thousand” should read -- 250,000 --.

Column 12,
Lines 20 and 28, “apparatus” should read -- apparatus according to --.

Signed and Sealed this

Twenty-eighth Day of January, 2003

JAMES E. ROGAN
*Director of the United States Patent and Trademark Office*